United States Patent [19]

Tsutsui et al.

[11] 4,392,473

[45] Jul. 12, 1983

[54] IGNITION COIL FOR AN INTERNAL COMBUSTION ENGINE

[75] Inventors: Mitsukuni Tsutsui, Naka; Takashi Yoshinari, Katsuta, both of Japan

[73] Assignee: Hitachi, Ltd., Tokyo, Japan

[21] Appl. No.: 209,661

[22] Filed: Nov. 24, 1980

[30] Foreign Application Priority Data

Nov. 22, 1979 [JP] Japan ..... 54-151670

[51] Int. Cl.[3] ..... F02P 3/06

[52] U.S. Cl. ..... 123/635; 123/647; 123/655

[58] Field of Search ..... 123/643, 635, 634, 633, 123/608, 647, 655

[56] References Cited

U.S. PATENT DOCUMENTS

| | | | |
|---|---|---|---|
| 2,346,094 | 4/1944 | Vogel | 123/635 |
| 3,566,202 | 2/1971 | Carr . | |
| 3,904,928 | 9/1975 | Sawada et al. . | |
| 3,910,247 | 10/1975 | Hartig . | |
| 3,935,852 | 2/1976 | Donovan et al. | 123/635 |
| 4,248,201 | 2/1981 | Tsutsui et al. | 123/634 |
| 4,308,488 | 12/1981 | Imai et al. | 123/655 |

FOREIGN PATENT DOCUMENTS

| | | | |
|---|---|---|---|
| 52-4937 | 1/1977 | Japan | 123/634 |
| 52-74727 | 6/1977 | Japan | 123/634 |
| 2064227 | 6/1981 | United Kingdom | 123/634 |

*Primary Examiner*—Parshotam S. Lall

*Attorney, Agent, or Firm*—Antonelli, Terry & Wands

[57] ABSTRACT

An ignition coil for an internal combustion engine including a first case of a hollow synthetic resin, which has one end fixing high voltage terminals for effecting connections with ignition plugs and its other end formed with an opening. Diode terminals are attached to the first case. The high voltage diodes which have the same side ends connected with the high voltage terminals from the first case and their other ends connected with the diode terminals. The high voltage diodes in the first case are encapsulated within an epoxy resin composite. Primary and secondary coils supplied with electric signals synchronized with a rotational speed in a secondary case to which primary and secondary terminals are attached. The second case is filled with an epoxy resin such that gaps between the wirings of the coils are sufficiently impregnated with that epoxy resin. The diode terminals and the secondary terminals are connected through the coils. The first case, accommodating the high voltage diodes and arranging the high voltage terminals in a row, the second case, accommodating the primary and secondary coils, the lead wires, and a portion of the primary terminals are molded of a synthetic resin into an integral structure.

12 Claims, 6 Drawing Figures

IGNITION COIL FOR AN INTERNAL COMBUSTION ENGINE

BACKGROUND OF THE INVENTION

The present invention relates to an ignition coil for use with an internal combustion engine, and more particularly to an ignition coil for igniting the internal combustion engine without the use of a distributor.

Some circuits for an ignition coil of the aforementioned type are, for example disclosed in U.S. Pat. No. 3,910,247, entitled "Method and Apparatus for Distributorless Ignition".

A contactless ignition coil having no mechanical distributor has advantages that there is no limit to the ignition timing, necessity for a high voltage cord connecting the ignition coil and the distributor, and no generation of interfering electric waves from the distributor.

However, since the conventional ignition coil of this kind is directly connected with a high voltage silicon diode of glass sealed type through a wiring, it takes a long time to connect the ignition coil and the high voltage diode, and it is necessary to accomplish the insulating treatment with care in order to ensure a voltage resistance insulation of about 30 KV.

SUMMARY OF THE INVENTION

It is therefore an object of the present invention to provide an ignition coil which is excellent in insulation characteristics and which capable of being used with a small-sized internal combustion engine.

In order to attain the aforementioned object, according to the present invention, high voltage terminals are connected between high voltage diodes and ignition plugs, and the high voltage terminals, the high voltage diodes and the ignition coils are integrally molded molded of a synthetic resin.

By molding the high voltage terminals, the high voltage diodes and the ignition coils with the synthetic resin into the integral structure, the insulating strength of the parts including the high voltage diodes and the ignition coils can be improved, as will become apparent from the following description. As a result, the respective spacings between the high voltage terminals, the high voltage diodes and the ignition coils can be so reduced that the overall size of the system according to the present invention can be accordingly reduced.

DESCRIPTION OF THE PREFERRED EMBODIMENTS

Figure 1:
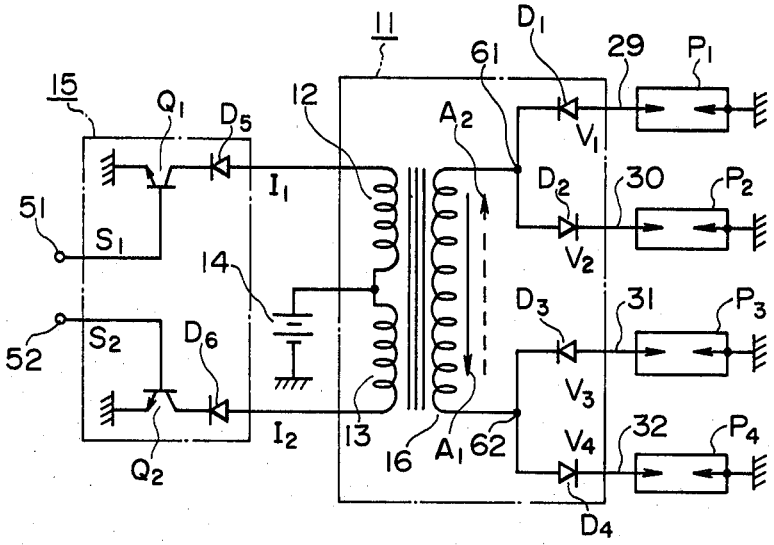
FIG. 1 is a circuit diagram showing the system including the ignition coil of the present invention to be used with an automotive four-cylinder engine.

Referring now to FIG. 1, according to this figure, the ignition system circuit of the present invention for an automotive four-cylinder engine includes an amplifier 15 for generating an electric signal synchronized with the R.P.M. or rotational speed of the engine, an ignition coil 11 according to the present invention for converting the electric signal supplied from the amplifier 15 into a DC high voltage and for feeding out the DC high voltage converted, and ignition plugs $P_1$, $P_2$, $P_3$ and $P_4$ made receptive of the DC high voltage from the ignition coil 11 for effecting the ignitions.

The amplifier 15 is composed of power transistors $Q_1$ and $Q_2$ and diodes $D_5$ and $D_6$. The power transistors $Q_1$ and $Q_2$ have their bases 51 and 52 fed with the electric signals $S_1$ and $S_2$ which are synchronized with the R.P.M. or rotational speed of the engine. Moreover, the power transistors $Q_1$ and $Q_2$ have their emitters grounded to the earth and their collectors connected with the cathodes of the diodes $D_5$ and $D_6$. The anodes of these diodes $D_5$ and $D_6$ are connected with the primary coils 12 and 13 of the ignition coil 11.

This ignition coil 11 is composed of the transformer, which, in turn, is composed of the primary coils 12 and 13 and a secondary coil 16, and high voltage diodes $D_1$, $D_2$, $D_3$ and $D_4$ which are connected with the secondary coil terminals of the transformer. The primary coils 12 and 13 have their common terminal connected with the plus terminal of a battery 14. The secondary coil 16 has its one output terminal 61 connected with the cathode of the high voltage diode $D_1$ and the anode of the high voltage diode $D_2$. The other output terminal 62 of the secondary coil 16 is connected with the cathode of the high voltage diode $D_3$ and the anode of the high voltage diode $D_4$.

Those diodes $D_1$ to $D_4$ are connected with the ignition plug $P_1$ of the first cylinder, the ignition plug $P_2$ of the second cylinder, the ignition plug $P_3$ of the third cylinder, and the ignition plug $P_4$ of the fourth cylinder, respectively.

Figure 2:
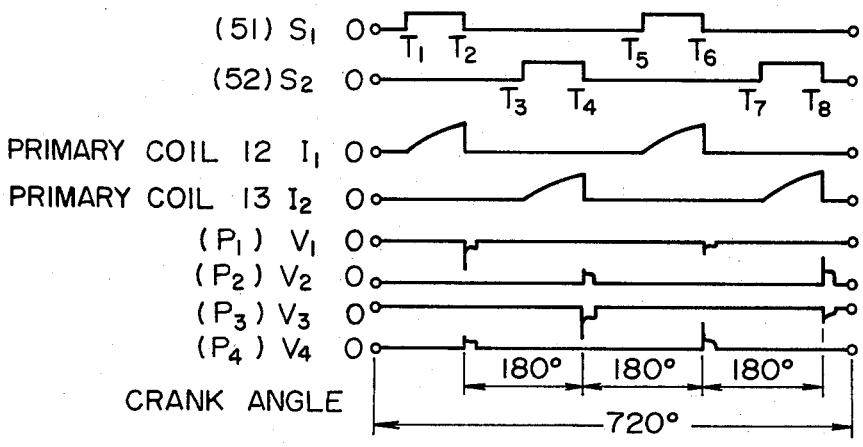
FIG. 2 is a time chart for illustrating the operations of the ignition system circuit shown in FIG. 1.

As is apparent from FIG. 2, let it be assumed that the electric signals $S_1$ and $S_2$ synchronized with the R.P.M. or rotational speed of the engine are fed to the input terminals 51 and 52 of the amplifier 15 and that the electric signal $S_1$ takes a value of 1 during the time periods from time $T_1$ to time $T_2$ and from time $T_5$ to time $T_6$; whereas, the electric signal $S_2$ takes a value of 1 during the time periods from time $T_3$ to $T_4$ and from time $T_7$ to time $T_8$. If the values of the electric signals $S_1$ and $S_2$ are preset to alternately take a value of 1 in the aforementioned ways, the power transistors $Q_1$ and $Q_2$ are alternately rendered conductive so that currents $I_1$ and $I_2$ alternately flow through the primary coils 12 and 13. Incidentally, the waveforms of the currents $I_1$ and $I_2$ appear, as shown in FIG. 2, in the form of saw teeth.

When the current $I_1$ flowing through the primary coil 12 is interrupted, a current $A_1$, as shown in a solid line in FIG. 1, flows through the secondary coil 16 so that high voltages $V_1$ and $V_4$ are generated in proportion to the aforementioned current $I_1$ at the high voltage diodes $D_1$ and $D_4$ thereby establishing sparks at the ignition plug $P_1$ of the first cylinder and the ignition plug $P_4$ of the fourth cylinder.

Likewise, when the current $I_2$ flowing through the primary coil 13 is interrupted, a current, as shown in a broken line, flows through the secondary coil 16 so that high voltages $V_2$ and $V_3$ are generated in proportion to the current $I_2$ at the high voltage diodes $D_2$ and $D_3$ thereby establishing sparks at the ignition plug $P_2$ of the second cylinder and the ignition plug $P_3$ of the third cylinder.

The pistons of the first and fourth cylinders are angularly spaced by 360 degrees from each other in terms of the crank angle so that the fourth cylinder is at its exhaust stroke while the first cylinder is at its ignition stroke. As a result, even if the ignition plugs $P_1$ and $P_4$ of the first and fourth cylinders simultaneously spark, no trouble is invited in the operation of the engine. Similar discussion applies to the case of the other ignition plugs $P_2$ and $P_3$. The lowermost illustration FIG. 2 depicts the relationships between the ignition timing of the ignition plugs $P_1$, $P_2$, $P_3$ and $P_4$ and the crank angle. Specifically, while the crankshaft is rotating twice, each ignition plug sparks or fires twice until it restores its initial state.

Figure 3:
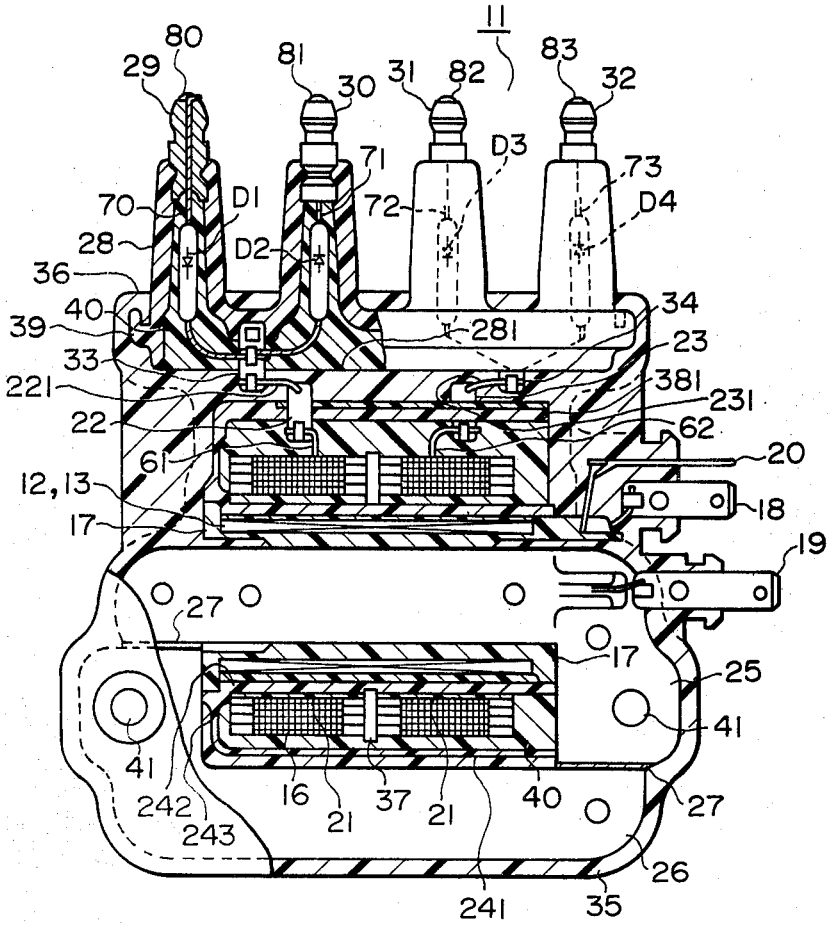
FIG. 3 is a sectional view showing an ignition coil according to one embodiment of the present invention.
Figure 4:
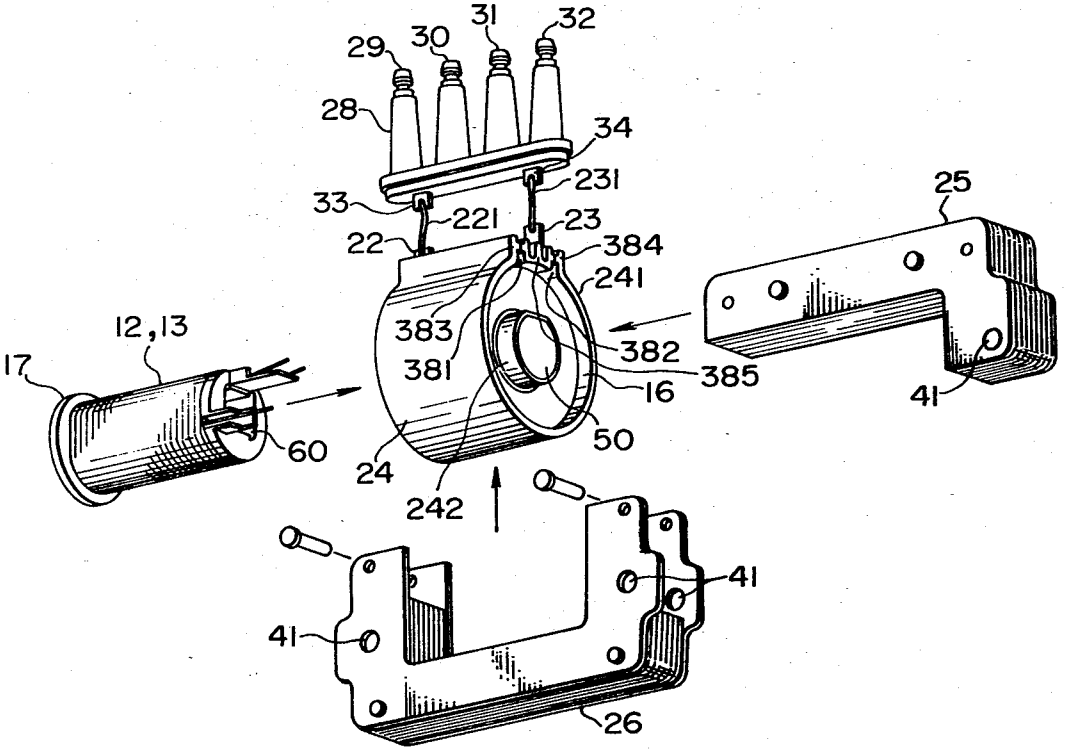
FIG. 4 is an exploded perspective view for explaining the assembling method of the ignition coil shown in FIG. 3.
Figure 5:
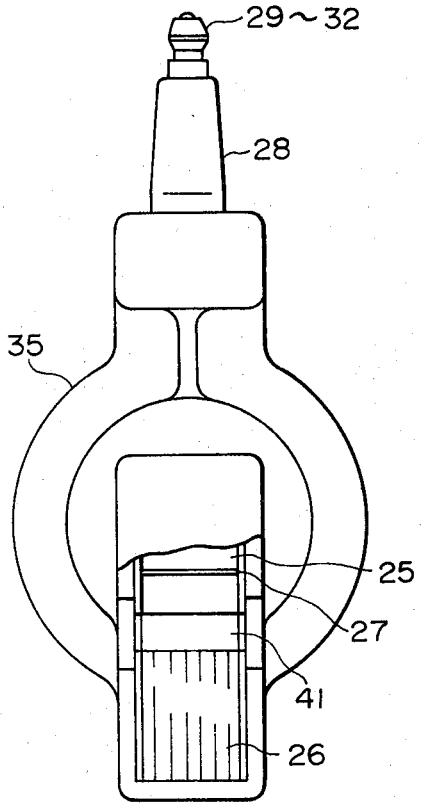
FIG. 5 is a lefthand side elevation of the ignition coil shown in FIG. 3.

With reference to FIGS. 3, 4 and 5, the ignition coil according to one embodiment of the present invention will now be described. In FIGS. 3, 4 and 5, the same parts as those of FIG. 1 are indicated at the same reference numerals.

The primary coils 12 and 13 are wound on a bobbin 17 such that the leading end of the primary coil 12 is connected with a primary terminal 18, the trailing end of the primary coil 12 and the leading end of the primary coil 13 are connected together with a primary terminal 19, and the trailing end of the primary coil 13 is connected with a primary terminal 20.

On the other hand, the secondary coil 16 is accommodated in a case 24 of a synthetic resin. This case 24 is constructed of outer and inner concentric walls 241 and 242 having different radii, and a bottom 243 which is disposed to ride over the same side ends of the outer and inner walls 241 and 242. The outer wall 241 of the case 24 is formed with protrusions 383 and 384 (FIG. 4) which protrude in the axial direction of the case 24 and which, in turn, are formed with elongated grooves 381 and 382. Between the protrusions 383 and 384, there is interposed another protrusion 385 formed to extend in the axial direction of the case 24 are spaced from the protrusions 383 and 384 by the elongated grooves 381 and 382.

The secondary coil 16 is fitted in the space between the outer and inner walls 241 and 242 of the case 24. More specifically, the secondary coil 16 is fitted in the case 24 through a spacer 27 of unwoven fabric of polyester after it has been wound in a laminated form upon two bobbins 21. Incidentally, the two portions of the secondary coil 16 are connected in series with each other.

The secondary coil 16 has its trailing ends 61 and 62 connected with secondary terminals 22 and 23, respectively. These secondary terminals 22 and 23 are inserted into the elongated grooves 381 and 382 and are then fixed in the case 24 by filling in the remaining upper recesses of the elongated grooves 381 and 382 with adhesive.

Here, the secondary terminals 22 and 23 are arranged on the case 24 such that they are spaced as remotely as possible from the protrusions 383 and 384 within such a range so as to avoid trouble in leading out the secondary coil 16. Although a voltage as high as 40 KV is impressed between the secondary terminals 22 and 23, the insulating strength between the secondary terminals 22 and 23 can be increased partly because the spacing between the secondary terminals 22 and 23 is made as large as possible, and partly because the protrusion 385 is provided to increase the creeping distance between the secondary terminals 22 and 23.

The secondary coil 16 is mounted on the outer sides of the primary coils 12 and 13 in a direction of the arrow in FIG. 4 by inserting the bobbin 17 carrying the primary coils 12 and 13 into the center hole 50 of the case 24 accommodating the secondary coil 16. After the bobbin 17 has been mounted on the case 24, the case 24, except for the center hole 50, is impregnated with a composite 40 of an epoxy resin in an evacuated chamber, and the composite 40 is then heated and set. Incidentally, quartz powders or the like are mixed into that epoxy resin composite 40 to thereby attain sufficient insulation and strength characteristics.

A core 25, which is constructed of laminated L-shaped silicon steel plates, is inserted in the direction of arrow shown in FIG. 4 into the center hole 60 of the bobbin 17 on which the primary coils 12 and 13 are wound. The core 25 thus constructed is combined through a spacer 27 made of a non-magnetic material, with the core 26, which surrounds the case 24, accommodating the secondary coil 16, thereby forming a group of closed magnetic path cores.

The aforementioned high voltage diodes $D_1$ to $D_4$ are of glass-sealed type and are accommodated in a case 28 made of a synthetic resin. Here, this case 28 has its one end fixing the high voltage terminals 29 to 32, which are formed with through holes for receiving the ends of the respective lead wires 70 to 73 of the high voltage diodes $D_1$ to $D_4$, respectively, and its other end made of such a hollow synthetic resin as is formed with the opening 281. In the case 28, moreover, the high voltage terminals 29 to 32 are arranged in the same plane, as is apparent in view of FIG. 5.

The high voltage diodes $D_1$ to $D_4$ have their lead wires 70 to 73 soldered, at the same side ends, to the end portions 80 to 83 of the high voltage terminals 29 to 32 through the through holes of the latter. The other ends of the lead wires 70 and 71 of the high voltage diodes $D_1$ and $D_2$ are connected with the diode terminal 33 which, in turn, is attached to the case 28. The other ends of the lead wires 72 and 73 of the high voltage diodes $D_3$ and $D_4$ are connected with the diode terminal 34 which, in turn, is also attached to the case 28. The diode terminals 33 and 34 are formed to extend to the outside of the opening 281 while having their same side ends fixed in the case 28.

The epoxy resin composite 40 is injected into the case 28 and is heated and set to form the terminal portions. The diode terminals 33 and 34 are connected with the secondary terminals 22 and 23 by way of lead wires 221 and 231, and the primary coils 12 and 13 in the case 24 are connected with the primary terminals 18, 19 and 20, respectively. Then, the case 28, the lead wires 221 and 231, and the case 24 are integrally encapsulated in a synthetic resin 35 to thereby construct the ignition coil 11.

Moreover, the case 28 is formed with a rib 39 over the whole outer circumference of the opening 281 thereof in order to prevent a clearance from being formed at the boundary 36 between the synthetic resin 35 and the case 28 due to the shrinkage or the like during the molding process of the synthetic resin 35.

As described above, the case 28 is molded of the synthetic resin, which may be suitably the reinforced polybutylene terephthalate mixed with glass fibers.

Moreover, if the casing synthetic resin 35 is also made of the above-specified material, it becomes possible to prevent the case 28 from being separated from the synthetic resin 35 and increase the mechanical strength.

According to the ignition coil of the embodiment thus far described, the following advantages can be obtained:

(1) Since the high voltage diodes $D_1$ to $D_4$ are integrally buried and the high voltage terminals 29 to 32 are arranged in a row to make it sufficient to effect the high voltage wiring only between the high voltage diodes and the ignition plugs, it is possible to simplify the wiring operations and to make the ignition system compact.

(2) Since the high voltage diodes are buried in the epoxy resin, it is possible to prevent any current from leaking in a creeping manner along the surfaces of the high voltage diodes $D_1$ to $D_4$ when these diodes are fed with a reverse voltage. As a result, it becomes possible to provide such an excellent ignition coil that practically has voltage resisting characteristics up to 40 KV.

(3) Since the coil unit and the high voltage diodes $D_1$ to $D_4$ molded separately from each other and are molded into the integral structure after their respective portions are electrically and mechanically strengthened, it is possible to reduce the percentage of defective of the finished ignition coils thereby improving the productivity.

Moreover, since the resin composite used has an excellent impregnating property which is sufficient to fill in the gaps between the windings of the secondary coil 16 as the synthetic resin is injected into the coil unit, and since the synthetic resin to be injected into the high voltage diode unit is blended with such a resin as has a linear expansion coefficient as high as that of the high voltage diodes $D_1$ to $D_4$, it is possible to provide an ignition coil which has high reliability and performance.

(4) Since the four high voltage terminals are molded and arranged in advance in the same plane, it is simple to insert the ignition coil according to the present invention into the mold for molding the ignition coil, and it is relatively easy to produce the mold itself. It therefore follows that the productivity is improved.

Figure 6:
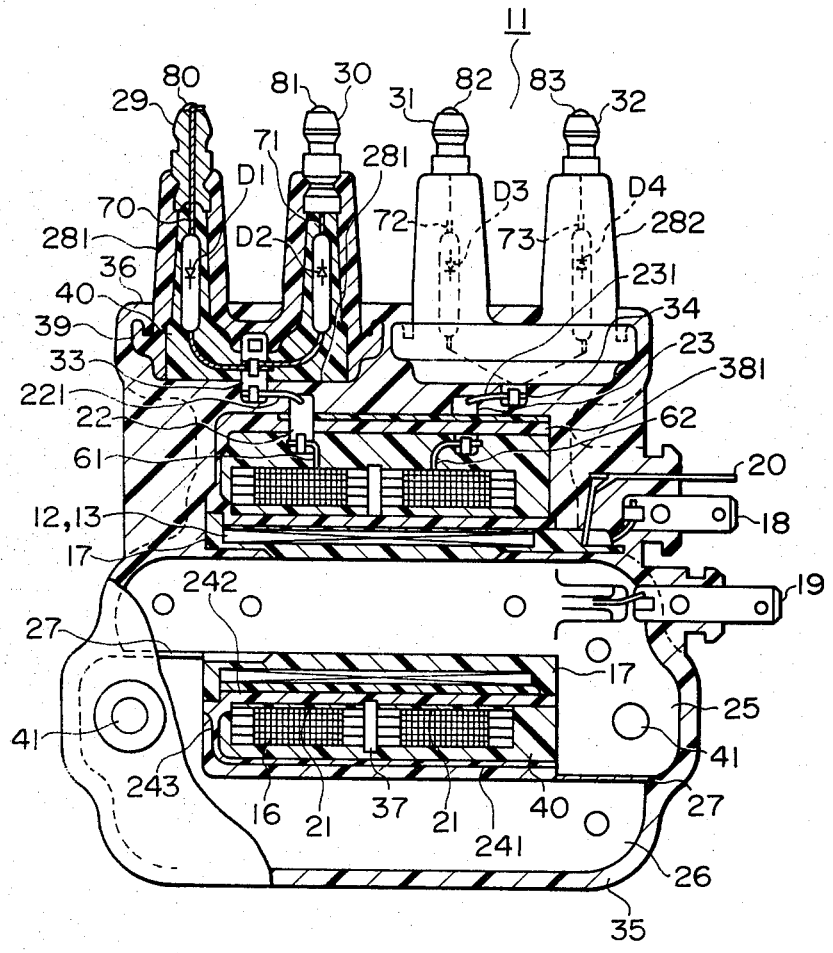
FIG. 6 is a sectional view showing an ignition coil according to another embodiment of the present invention in the case of a plurality of cases of a synthetic resin for accommodating high voltage diodes.

The difference between the ignition coils shown in FIGS. 6 and 3 resides in that the high voltage diodes $D_1$ to $D_4$ of the former are accommodated in a plurality of cases 281 and 282; whereas, the high voltage diodes $D_1$ to $D_4$ of the latter are accommodated in the single case. In FIG. 6, the same parts as those of FIG. 3 are indicated at the same reference numerals.

According to the ignition coil shown in FIG. 6, the cases 281 and 282 are separated by the synthetic resin 35, and the diode terminals 33 and 34 are completely separated from each other. As a result, it is possible to provide the ignition coil which is free from any internal discharge between the diode terminals 33 and 34 so that it exhibits more excellent voltage resisting characteristics.

What is claimed is:

1. An ignition coil for an internal combustion engine for producing high voltage signals to spark plugs of the internal combustion engine, the ignition coil comprising at least one primary coil to which primary current signals are supplied in sychronism with a rotational speed of the internal combustion engine, a secondary coil electromagnetically coupled to said at least one primary coil for producing high voltage signals in response to the primary current signals, high voltage terminals for enabling a connection of the secondary coil with the spark plugs, high voltage diodes disposed between the secondary coil and the high voltage terminals, means for electrically connecting the secondary coil to the high voltage diodes, a case means formed at least in part from an insulating material having the high voltage terminals mounted thereon and accommodating the high voltage diodes therein in a manner so as to be insulated with respect to each other, and a synthetic resin for enveloping the primary and secondary coils and integrally joining the case to said primary and secondary coils.

2. An ignition coil for an internal combustion engine as set forth in claim 1, wherein said high voltage terminals are mounted on said case means in the same plane.

3. An ignition coil for an internal combustion engine as set forth in claim 1, wherein said high voltage diodes include:

first one-way current feeding means for feeding an electric current to said ignition plugs, when the electric current induced in said secondary coil flows in one direction, and for blocking the electric current to said ignition plugs when the electric current induced in said secondary coil flows in the reverse direction; and second one-way current feeding means for feeding an electric current to said ignition plugs, when the electric current induced in said secondary coil flows in the reverse direction, and for blocking the electric current to said ignition plugs when the electric current induced in said secondary coil flows in one direction.

4. An ignition coil for an internal combustion engine as set forth in claim 1, wherein said high voltage diodes include:

first current feeding means including a pair of first one-way current feeding means for feeding an electric current to said ignition plugs, when the electric current induced in said secondary coil flows in one direction, and for blocking the electric current to said ignition plugs when the electric current induced in said secondary coil flows in the reverse direction; and second current feeding means including a pair of second one-way current feeding means for feeding an electric current to said ignition plugs, when the electric current induced in said secondary coil flows in the reverse direction, and for blocking the electric current to said ignition plugs when the electric current induced in said secondary coil flows in one direction.

5. An ignition coil for an internal combustion engine for producing high voltage signals to spark plugs of the engine, the ignition coil comprising at least one primary coil, at least one secondary coil coupled to said primary coil, high voltage terminals for enabling a connection of the secondary coil with the spark plugs, high voltage diodes disposed between the secondary coil and the high voltage terminals, a hollow first case of a synthetic resin, the first case having a first end for fixing of said high voltage terminals thereon and a second end formed with an opening, and first terminal means having a first end fixed in said first case and a second end electrically connected with said secondary coil, wherein said high voltage diodes are accommodated in said first case while having first ends connected with said high voltage terminals and second ends connected with said terminal means, said high voltage diodes in said first case are encapsulated in a resin composite in said first case, and wherein a synthetic resin envelops the primary and secondary coils and integrally joins said first case to said primary and secondary coils.

6. An ignition coil for an internal combustion engine as set forth in claim 5, wherein said synthetic resin of said first case has a substantially equal thermal expansion coefficient to that of one of said high voltage diodes and the resin composite.

7. A ignition coil for an internal combustion engine as set forth in claim 5, further comprising:

a second case made of a synthetic resin, the second case being constructed of two cylinders including concentrically disposed outer and inner walls having different radii, the outer and inner walls are separated from each other so as to form a space therebetween, and a bottom wall disosed over one of a pair of end portions of said two cylinders so as to form a first hollow cylinder extending along an inner surface of said inner wall;

the secondary coil is accommodated in said space between the outer and inner walls of said second case;

second terminal means attached to the outer wall of said second case having a first end electrically connected with a coil end of said secondary coil and a second end electrically connected with said high voltage diodes;

a bobbin adapted to be inserted into said first hollow cylinder, said bobbin being formed with a second hollow cylinder which extends in an axial direction;

the at least one primary coil being wound on said bobbin and inserted into said first hollow cylinder together with said bobbin;

and resin composite impregnating an interior of said bobbin and said second case except said second hollow cylinder; and a closed magnetic path core formed by a first core fitted in said second hollow cylinder and a second core magnetically coupled with said first core outside said second case.

8. An ignition coil for an internal combustion engine as set forth in claim 7, wherein said second case has its outer wall formed with a first protrusion, a first elongated groove provided in the first protrusion and extending in the axial direction of said second case, a second protrusion, formed with a second elongated groove, and a third protrusion extending in an axial direction of said second case and spaced from said first and second protrusions through said elongated grooves, and wherein said second terminal means are respectively fitted and fixed in said first and second elongated grooves in a manner so as to increase a spacing therebetween.

9. An ignition coil for an internal combustion engine as set forth in claim 5, wherein said first case is formed with a rib over the whole circumference of the opening thereof, whereby any clearance can be prevented from being formed at a boundary between said synthetic resin enveloping the primary and secondary coils and said first case due to a shrinkage during a molding process of said synthetic resin enveloping the primary and secondary coils.

10. An ignition coil for an internal combustion engine as set forth in claim 5, wherein said first case is divided into a plurality of individual integrally molded case portions.

11. An ignition coil for an internal combustion engine for producing high voltage signals synchronized with a rotational speed of the engine to spark plugs of the engine, the ignition coil comprising at least one primary coil, at least one secondary coil coupled to said primary coil, high voltage terminals for enabling connection of the secondary coil with the spark plus, high voltage diodes disposed between the secondary coil and the high voltage terminals, a case made of a synthetic resin having concentric inner and outer walls and a bottom wall bridging said inner and outer walls at one end portion thereof so as to form a first center hollow cylinder extending inside said inner wall and a space for accommodating the secondary coil between said inner and outer walls, terminal means attached to said outer wall of said case having one end connected electrically with a coil end of the secondary coil and a second end electrically connected with said high voltage diodes, a bobbin adapted to be inserted in said first center hollow cylinder and formed with a second center hollow cylinder extending in an axial direction thereof, the primary coil being wound on said bobbin, a resin composite impregnating around said bobbin and said case, and a magnetic core disposed in said second center hollow cylinder, said synthetic resin case being integrally molded with said high voltage diodes and said high voltage terminals.

12. An ignition coil for an internal combustion engine as set forth in claim 11, wherein said magnetic core comprises a first portion arranged in said second center hollow cylinder and a second portion magnetically coupled with said first portion and disposed outside said case.

* * * * *